US010612538B2

(12) United States Patent
Baker

(10) Patent No.: US 10,612,538 B2
(45) **Date of Patent: *Apr. 7, 2020**

(54) INTEGRATED WIRELESS DATA SYSTEM AND METHOD FOR PUMP CONTROL

(71) Applicant: TECAT PERFORMANCE SYSTEMS, LLC, Ann Arbor, MI (US)

(72) Inventor: Douglas M. Baker, Ypsilanti, MI (US)

(73) Assignee: Tecat Performance Systems, LLC, Ann Arbor, MI (US)

( * ) Notice: Subject to any disclaimer, the term of this patent is extended or adjusted under 35 U.S.C. 154(b) by 195 days.

This patent is subject to a terminal disclaimer.

(21) Appl. No.: 15/628,013

(22) Filed: Jun. 20, 2017

(65) Prior Publication Data

US 2017/0363079 A1 Dec. 21, 2017

Related U.S. Application Data

(60) Provisional application No. 62/352,056, filed on Jun. 20, 2016.

(51) Int. Cl.

| | |
|---|---|
| ***F04B 49/06*** | (2006.01) |
| ***F04B 47/02*** | (2006.01) |
| ***F04B 51/00*** | (2006.01) |
| ***E21B 47/00*** | (2012.01) |
| ***F04B 49/02*** | (2006.01) |

(52) U.S. Cl.

CPC ..... *F04B 49/065* (2013.01); *E21B 47/0008* (2013.01); *F04B 47/02* (2013.01); *F04B 47/022* (2013.01); *F04B 49/02* (2013.01); *F04B 51/00* (2013.01); *F04B 2201/0202* (2013.01); *F04B 2201/121* (2013.01)

(58) Field of Classification Search

CPC ..... E21B 47/0008; F04B 47/022; F04B 2201/121; F04B 2201/0202; F04B 47/02; F04B 51/00; F04B 49/065

See application file for complete search history.

(56) References Cited

U.S. PATENT DOCUMENTS

| | | | | |
|---|---|---|---|---|
| 5,182,946 | A * | 2/1993 | Boughner | E21B 47/00 702/6 |
| 7,032,659 | B2 * | 4/2006 | Barnes | F04B 47/02 166/104 |
| 7,513,752 | B2 * | 4/2009 | Boone | E21B 47/0008 166/250.1 |
| 9,033,676 | B2 * | 5/2015 | Palka | E21B 43/127 417/44.1 |
| 9,080,438 | B1 * | 7/2015 | McCoy | E21B 47/18 |
| 10,302,510 | B2 * | 5/2019 | Baker | F04B 47/02 |
| 2013/0127390 | A1 * | 5/2013 | DaCunha | H02P 5/74 318/490 |
| 2016/0124574 | A1 * | 5/2016 | Rouaissia | G06F 3/0418 345/174 |
| 2016/0138949 | A1 * | 5/2016 | Zhao | G01D 21/02 73/781 |

* cited by examiner

*Primary Examiner* — Charles G Freay

(74) *Attorney, Agent, or Firm* — John S. Artz; Dickinson Wright PLLC

(57) ABSTRACT

An integrated wireless data system and method for controlling and measuring operational data of a pumpjack system, for safety, health monitoring, and pump control is provided. The integrated wireless data system and method may be configured to allow for bi-directional communication with a central station to enable human intervention with pumpjack and to store pump parameters in a database for use in development of predictive maintenance techniques.

12 Claims, 4 Drawing Sheets

INTEGRATED WIRELESS DATA SYSTEM AND METHOD FOR PUMP CONTROL

CROSS REFERENCE TO RELATED APPLICATION

This U.S. Utility Application claims the benefit of U.S. Provisional Application Ser. No. 62/352,056 filed Jun. 20, 2016, which is incorporated herein by reference in its entirety.

FIELD OF DISCLOSURE

The present disclosure generally relates to an integrated wireless data system for measuring operational characteristics of a pumpjack of a rod-pumped well and a method for measuring the operational characteristics of the pumpjack, storing data associated with the operational characteristics for diagnostic purposes and using the data to control the motor of the pumpjack.

BACKGROUND OF THE DISCLOSURE

Pumpjack systems are well-known in the oil and gas industry. These systems are designed to pump fluid out of a well and typically have separate assemblies and controllers to measure and control characteristics of pumpjack equipment including: measuring the speed at which the system is pumping, turning the pump on or off based on the weight of the fluid in the production tubing, measuring strain on the rod itself, or a combination of characteristics, such as measuring the strain and location of the polished rod relative to ground level. Measuring and controlling these characteristics is important for efficiency, health monitoring, and safety of the pumpjack. If the characteristics are not monitored properly, damage can be caused to parts of the pumpjack.

In measuring these characteristics, it is sometimes desirable to obtain high frequency data for improved diagnostics, in the event an anomaly occurs. For example, if there is a sudden spike in the strain on the polished rod, it can be helpful to record high-speed data surrounding the anomaly to aid in pinpointing the cause of the spike, and to determine whether or not it is a potential issue. Furthermore, it is desirable to monitor multiple characteristics of a pumpjack system and to store this data, so as to develop a predictive maintenance procedure for the system.

Wired systems have been used for this application, but due to the nature of the relative motion between parts in a pumpjack system, wires frequently break and need to be repaired. To address this issue, wireless systems were developed to collect the pumpjack operating characteristics.

One example of a current system includes U.S. Pat. No. 7,032,659 B2, which discloses a wireless system for pump control. The disclosed systems measures strain and position of a pumpjack structure and transmits control signals to a motor control panel. The system is mounted to the walking beam of a pumpjack structure. The system uses a transmitter in a control unit and a receiver in a motor control panel, and is therefore limited to mono-directional communications. In addition, the system only accounts for the measurements of strain and position, and does not measure other operational characteristics of the pumpjack system. Furthermore, the system is large, requiring that it be mounted to the top of the walking beam of the pumpjack system. The disclosure does not address transmission power, data rate or power consumption. The power consumption of a high-power transmission system required for the wide-open regions and indirect line of sight installations typical of this application, combined with the power consumption of a high-frequency wireless system, have precluded existing wireless systems from successful implementation in the field. In addition, because pumpjacks are often located in remote areas, changing batteries may be costly.

Thus, there is a need for a wireless data system that can directly measure operating characteristics of the pumpjack, process a pump control signal from that data, and send the raw data and/or the processed signal for pump control. There is also a need to collect data at sufficiently high data rates to capture rod resonance frequencies and down-hole impact signatures. Further, there is a need for a transceiver-based system that uses bi-directional communications to enable altering data collection parameters such as data rate, data quality, transmission energy, etc. for purposes of improving diagnostics when needed while managing consumed energy when not. There is also a need to wirelessly transmit this data to a central station for long-term data storage to enable implementation of predictive maintenance techniques for the pump system. Furthermore, to ensure successful implementation in the field, there is a need for a system that minimizes consumed energy to ensure long battery life, while meeting the power transmission and data rate requirements of this application.

SUMMARY AND ADVANTAGES OF THE DISCLOSURE

According to an aspect of the disclosure, an integrated wireless data system for measurement of operating characteristics of a pumpjack is provided. The integrated wireless data system may include a remote unit mounted to the pumpjack. The remote unit has at least one sensor and remote transceiver and an amplifier and an A/D converter and at least one low impedance switch and a microprocessor and an energy harvesting device for measuring data associated with the operational characteristics. The remote unit may also include a power storage device connected to and for providing power to the remote unit. The system can also include a base unit located in a motor control panel of the pumpjack. The base unit can have a base transceiver and an amplifier and a microprocessor connected to and in communication with a motor controller for controlling a motor of the pumpjack. The remote unit and the base unit and the central station are in wireless communication with one another to exchange real-time data bi-directionally.

According to another aspect of the disclosure, a method for measuring operational characteristics of a pumpjack under real-world operating conditions is also provided. The method can include the step of installing a remote unit on a component of the pumpjack. The method proceeds by measuring the operational characteristics of the pumpjack using the remote unit. The remote unit then wirelessly transmits the operational characteristics to a base unit located within a motor control panel of the pumpjack. Based on operational characteristics indicated by the control signal, the base unit may generate a second control signal for adjusting the motor control sequence which may adjust the operating characteristic of a motor of the pumpjack based on the second control signal. The method can also include converting measured strain measurements to at least one of an orthogonal bending and an axial strain and a torque of the component of the pumpjack. The method can conclude by compensating the operational characteristics for temperature effects. According to yet another aspect of the disclosure, a method to configure an integrated wireless data system including a base unit in wireless communication with a remote unit and with a central station to download and analyze data collected by the integrated wireless data system is also provided. The method begins by collecting data using the remote unit and the base unit of the integrated wireless data system. Next, downloading the data from the central station onto a PC. The method can conclude by storing the data in a database on the PC for historical analysis.

The aspects of the present disclosure present various advantages over current systems. For instance, an integrated wireless data system that is a transceiver-based system allows for bi-directional communications which enables the base unit to alter data acquisition parameters of the remote unit. One benefit of this could be to improve battery life while increasing diagnostic capabilities by continuously transmitting operational data at low frequencies, and only switching the remote unit to collect high frequency data when an anomaly occurs. In addition, the system and method allow for the measurement of multiple parameters with a single remote unit with a small footprint, enabling it to be mounted easily to various components of the pumpjack system, such as the polished rod. Further, the sensor assembly contains an on-board microprocessor, enabling transmission of a control signal that has been processed based on all sensor inputs. This further reduces power consumption due to a reduction in the amount of data that needs to be transmitted. The system and method allow for the transmission of data to a central station, which can receive data from multiple remote units and multiple base units associated with multiple pumpjacks. Further, the system and method provide for an ultra-low power algorithm that enables high power transmission of data collected at high data rates while ensuring long battery life.

BRIEF DESCRIPTION OF THE DRAWINGS

Other aspects of the present disclosure will become better understood by reference to the following description when considered in connection with the accompanying drawings wherein.

DETAILED DESCRIPTION OF THE PRESENT DISCLOSURE

Detailed aspects of the present disclosure are provided herein; however, it is to be understood that the disclosed aspects are merely exemplary and may be embodied in various and alternative forms. It is not intended that these aspects illustrate and describe all possible forms of the disclosure. Rather, the words used in the specification are words of description rather than limitation, and it is understood that various changes may be made without departing from the spirit and scope of the disclosure. As those of ordinary skill in the art will understand, various features of the present disclosure as illustrated and described with reference to any of the Figures may be combined with features illustrated in one or more other Figures to produce examples of the present disclosure that are not explicitly illustrated or described. The combinations of features illustrated provide representative examples for typical applications. However, various combinations and modifications of the features consistent with the teachings of the present disclosure may be desired for particular applications or implementations. Additionally, the features and various implementing embodiments may be combined to form further examples of the disclosure.

Figure 1:
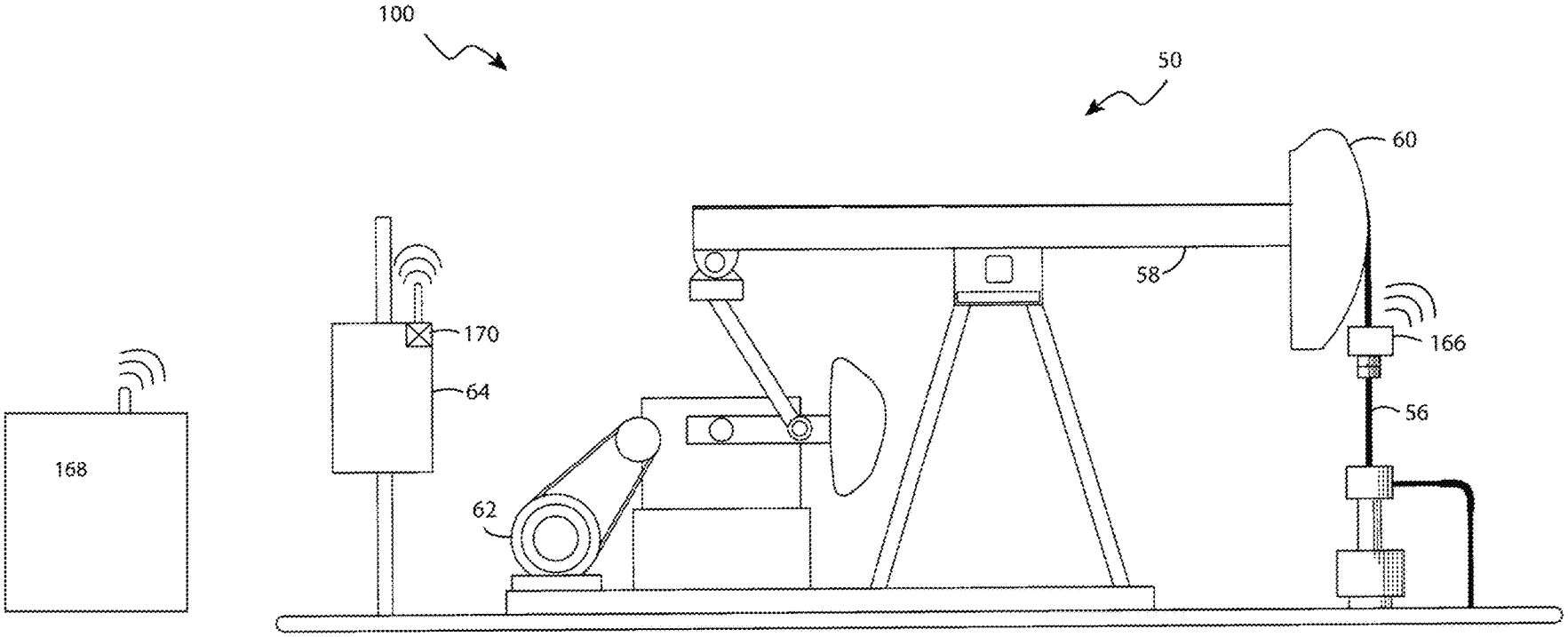
FIG. 1 is an illustration of an example of an integrated wireless data system mounted on the polished rod of a pumpjack for measuring operational data of the pumpjack and for controlling the pumpjack motor in accordance with an aspect of the present disclosure.

FIG. 1 is an illustration of an example of an integrated wireless data system 100 disposed on a pumpjack 50 for measuring and controlling one or more components of the pumpjack 50 in accordance with an aspect of the present disclosure. The pumpjack 50 may include a polished rod 56, a walking beam 58, a horse head 60, a motor 62, and a motor control panel 64. In operation, the polished rod 56 moves up and down in the oil and/or gas extraction process. The polished rod 56 may be connected to the horse head 60, which may further be attached to a walking beam 58. The pumpjack 50 may be powered by the motor 62, which may be controlled by the motor controller 64.

In one aspect, the integrated wireless data system 100 may include at least one remote unit 166 and at least one central station 168 and at least one base unit 170, each in wireless communication with one another. The remote unit 166 may be mounted to the polished rod 56 of the pumpjack system 50. The central station 168 may be located within transmitting distance to the remote unit 166 and the base unit 170 may be mounted in the motor controller panel 64. In operation, the remote unit 166 may be configured to measure multiple operating characteristics of the pumpjack 50. The operational characteristics may include, but are not limited to, axial load, strain, torque, temperature, pressure, humidity, acceleration, orientation, and the like. The remote unit 166 may transmit a plurality of signals including data associated with the operational characteristics and/or a control signal to the base unit 170 and/or to the central station 168. The base unit 170 may be configured to receive the plurality of signals from the remote unit 166 and use that information to control the motor 62 of the pumpjack 50. The central station 168 may be configured to receive the plurality of signals from the remote unit 166, so as to store the information into a database of operating characteristics of multiple pumpjacks 50. This database may be configured to analyze incoming data and conduct long term diagnostics on each of the pumpjacks 50. Incoming data may be compared to historical data, and the central station 168 may transmit signals to both the base units 170 and the remote units 166 to alter the motor control sequence and/or to alter the rates at which the remote units 166 collect data. The central station 168 may also be configured to alert an operator in the event of an anomaly.

Figure 2:
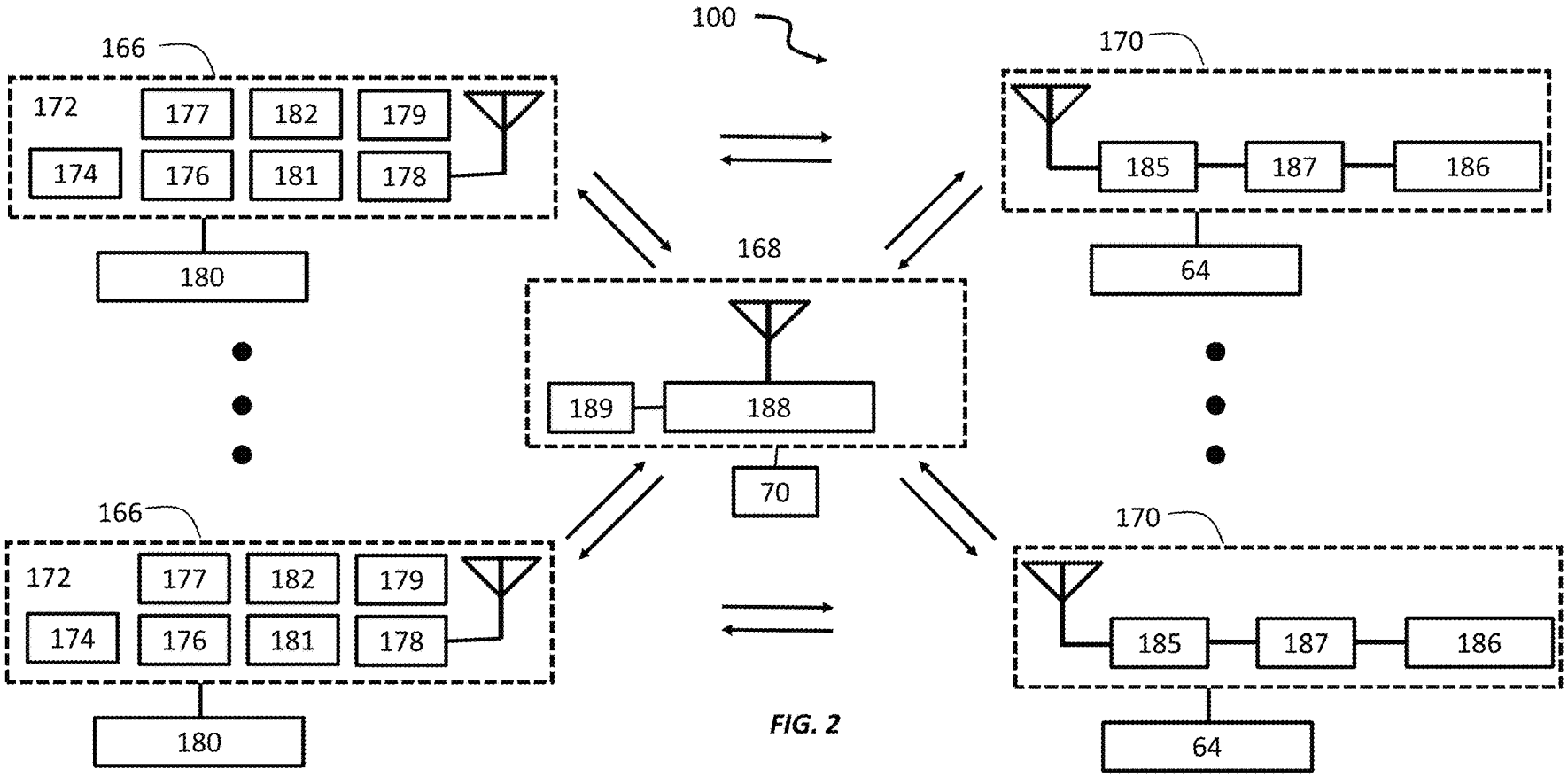
FIG. 2 is a block diagram of an example of the system architecture in accordance with an aspect of the present disclosure.

FIG. 2 is a block diagram of the wireless integrated system 100 in accordance with the present disclosure. In particular, FIG. 2 shows the respective system architecture of a plurality of remote units 166 and a plurality of base units 170 and the central station 168. Each of the remote units 166 may include a circuit board 172 comprised of at least one sensor 174 and at least one low impedance switch 175 and a microprocessor 176 and an A/D converter 177 and an amplifier 179 (e.g., high-gain) and a remote transceiver 178 (e.g., high-gain) electrically coupled to one another. Because the amplifier 179 can be a higher gain RF amplifier (providing RF signals>3.5 dbm, up to 24 dbm), improved RF reception under the difficult transmission environment of the pumpjack 50 is advantageously provided. Since pumpjacks 50 are commonly located in an open field, there are not many surfaces to reflect RF energy off of so higher power is required to assure that the signal is properly transmitted between the remote units 166 and base units 170.

The at least one sensor 174 may include, but is not limited to, a load cell, strain gauge, accelerometer, gyroscope, temperature sensor, humidity sensor, pressure sensor, or a combination thereof. Data from the at least one sensor 174 may be collected at sufficiently high data rates to resolve the high frequency signatures associated with pumpjack 50 and fluid interactions and/or rod and hole interactions (e.g., of polished rod 56 within a hole in which it moves). The A/D converter 177 and the microprocessor 176 resolve the collected data to a digital signal which is then transmitted to the base unit 170 via the amplifier 179 and the remote transceiver 178. The remote unit 166 may also contain a plurality of low impedance, digitally controlled switches 182 to enable rapid reconfiguration of the gauge circuitry to measure various strain components of strain gauges, when at least one strain gauge is used as one of the sensors 174. These strain components can be, but are not limited to orthogonal bending strains, pure axial strain and torque.

The central station 168 can include an amplifier 189 (e.g., high-gain) and a central station transceiver 188 (e.g., high-gain) for communication with the base unit 170 and/or remote unit 166. According to an aspect, the central station may also be coupled to a connected PC 70 to store the information into the database of operating characteristics of multiple pumpjacks 50 as described above.

Each of the base units 170 includes a base transceiver 185 (e.g., high-gain) coupled to a microprocessor 186 and an amplifier 187 (e.g., high-gain). The base units 170 may also include onboard data storage and D/A convertor and be connected to the power supply of the motor control panel 64. In one example, the base transceiver 185 on the base unit 170 could send an instruction to the remote transceiver 178 on the remote unit 166 to change from measuring axial load data to measuring bending data, which requires independent detection of strain in two orthogonal planes to capture the total bending vector, comprised of both magnitude and direction.

The microprocessor 176 of the remote unit 166 may be capable of processing all of the data from the plurality of sensors 174 in order to determine a control signal. The control signal can be wirelessly transmitted from the remote transceiver 178 to the base transceiver 185 for use in the motor control sequence, so as to adjust the speed of the motor 62 in accordance with the measured data. The control signal can also be wirelessly transmitted from the remote transceiver 178 to the central station transceiver 188 for storage in a database on the connected PC 70 for long term data analysis. The central station 168 can then be used to track long-term data of one or more pumpjacks 50 so as to develop improved diagnostics, health monitoring, predictive maintenance techniques, and other data mining uses that would be known to one skilled in the art.

According to one aspect of this disclosure, the base unit 170 and/or central station 168 may communicate back to the remote unit 166, as all are equipped with transceivers 185, 188 and 178. This allows for the base unit 170 or central station 168 to send requests to the remote unit 166 to change data acquisition parameters. These requests may include, but are not limited to, changing the frequency at which data is collected, turning on or off one of the sensors 174, putting a complete remote unit 166 into sleep mode or off mode, sending a revised calibration to one of the sensors 174, changing the gauge circuitry of a strain gauge through a low impedance switch 182 and the like. These requests to the remote unit 166 can be configured to be automatic, based on pre-defined conditions, and/or it can be configured to involve human intervention from the central station 168.

A power management strategy for the remote unit 166 is also disclosed. The circuit board 172 on the remote unit 166 may be powered by a power source 180 which may be a battery or any other type of power source and may be connected to an energy harvesting device 181 such as a solar power device. Ultra-low power algorithms enable the combination of three key characteristics that are critical to the performance of a wireless integrated data system: long-term use, for instance, up to two or three years of continuous operation at 100 Hz using a single D-cell battery without the need to recharge or replace batteries in the remote unit 166; high-speed data collection, necessary to capture high frequency signatures caused by pump and fluid interactions and/or rod and hole interactions; and high power transmission, needed to ensure that data is able to be transmitted from the remote unit 166 to the base unit 170 and/or central stations 168 under real-world operating conditions, which, in this case, include pumpjack hardware interference and electrical interference from RF or EMF emissions. As part of this algorithm, the remote unit 166 enters a sleep mode when not in use, further minimizing power consumption. In addition, because the system contains a remote transceiver 178, the remote unit 166 can be set to periodically collect high frequency measurements in order to assess system diagnostics, and then be changed to collect data at a lower rate, further lowering energy consumption.

Figure 3A:
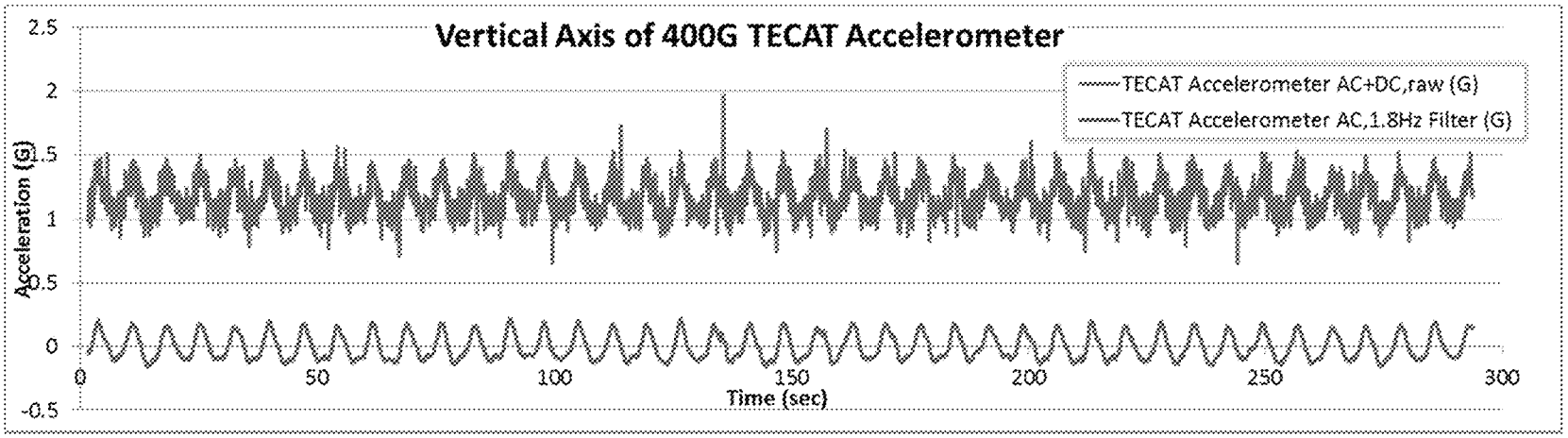
FIGS. 3A and 3B are graphical illustrations of measurements taken from a polished rod of a pumpjack via a sensor assembly in accordance with an aspect of the present disclosure.
Figure 3B:
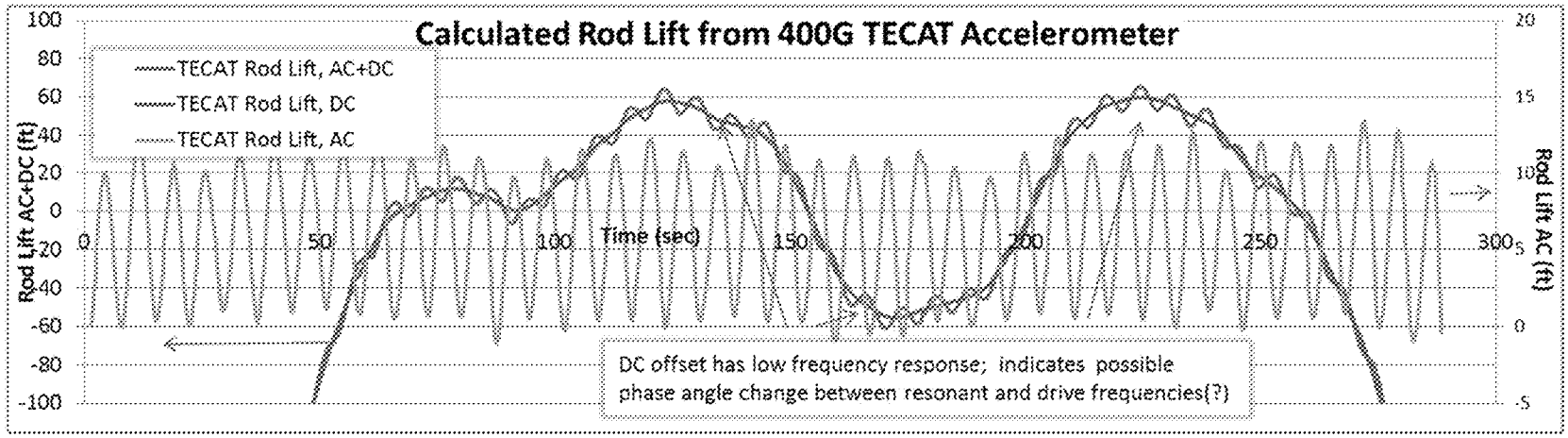

FIGS. 3A and 3B are graphical illustrations of measurements taken from the polished rod 56 of the pumpjack 50 via the at least one sensor 174 (e.g., an accelerometer) in accordance with an aspect of the present disclosure. FIG. 3A illustrates the measured vertical acceleration of the polished rod 56 using the remote unit 166 during multiple pumping cycles. The raw data exhibits a 1 g offset due to the gravitational field on the vertical axis, and an additional 0.2 g offset due to a zeroing error in the +/−400 g accelerometer when used in the +/−100 g range. FIG. 3A also demonstrates the vertical acceleration when the offsets are subtracted and the data are digitally filtered with a 1.8 Hz low-pass filter. FIG. 3B shows a calculated rod lift of the polished rod 56 using the filtered, AC vertical accelerometer data. Rod lift is calculated by numerically integrating acceleration to determine velocity, then numerically integrating velocity to determine displacement. The DC component of the displacement signature was calculated using a digital low pass filter and then subtracted off of the originally calculated signature to determine an AC displacement signature. This signature was then offset to show a zero lift at the bottom of the rod stroke of the polished rod 56. While some cycle-to-cycle variability is observed, the data provides a reasonable estimate of rod position of the polished rod 56 throughout the pumping cycle. In addition, the accuracy and resolution of this data would be significantly improved with the use of a tighter tolerance accelerometer with a smaller range.

Figure 4:
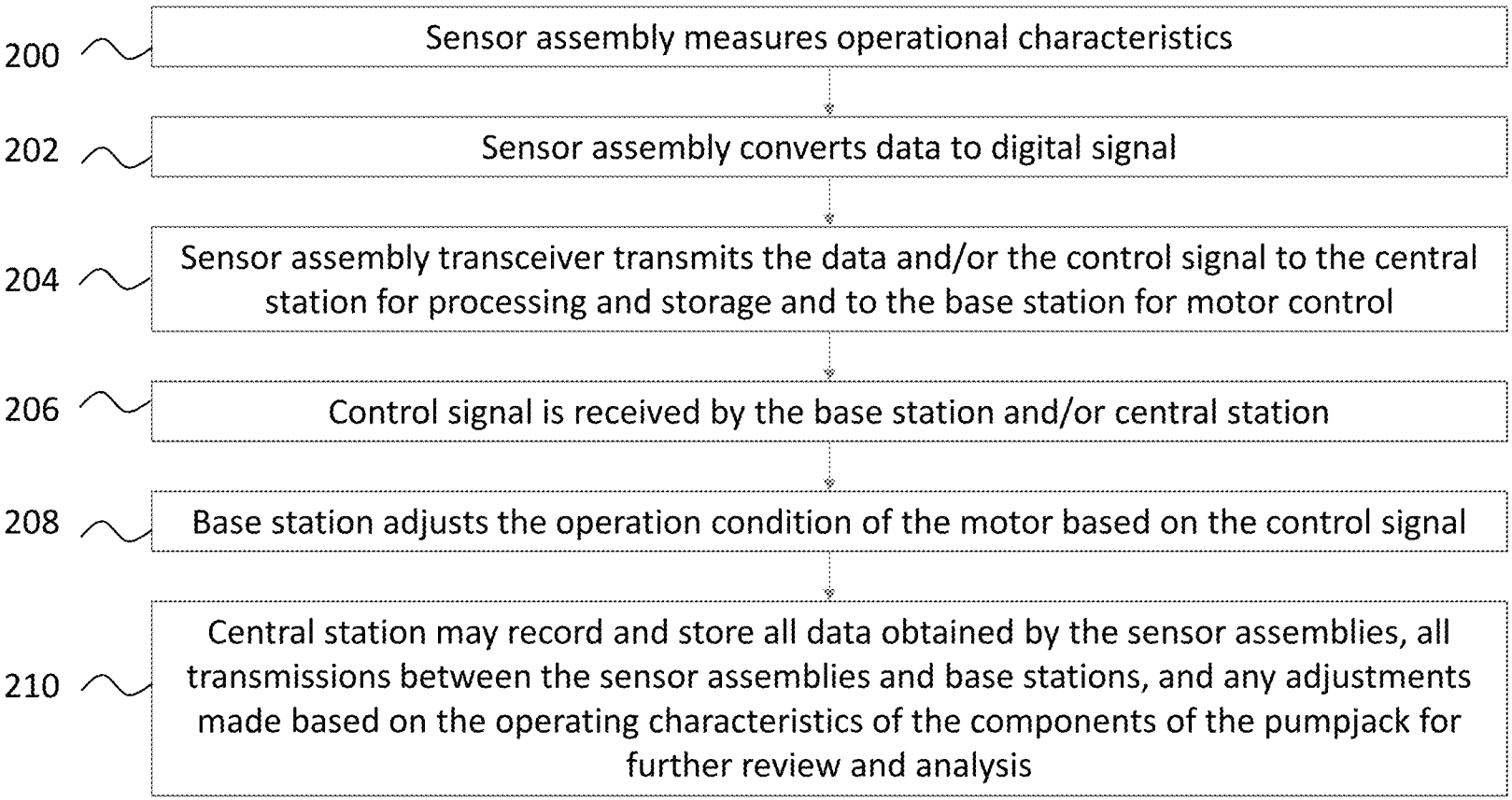
FIG. 4 is a flowchart of a method for measuring operational data of a pumpjack and for controlling a pumpjack motor using an integrated wireless data system in accordance with an aspect of the present disclosure.

FIG. 4 is a flowchart of a method for controlling and measuring operational data of one or more components within a pumpjack 50 using the integrated wireless data system 100. As discussed above, the integrated wireless data system 100 may include a plurality of remote units 166 and a plurality of base units 170 and at least one central station 168. The method may include 200 measuring an operational characteristic of the pumpjack 50 while it is operating, via the at least one sensor 174 within the remote unit 166. Once the operational characteristics are measured, the next step 202 is the microprocessor 176 within the remote unit 166 converts the data into a control signal indicating the operational characteristic of the pumpjack 50. The next step 204 is the remote transceiver 178 transmitting the control signal to the central station 168 for processing and storage for later use, and to the base unit 170. Transmission may occur using RF transmission.

The method continues with the step of 206 in which the control signal may be received by the base transceiver 185 and/or central station transceiver 188 and may be processed by each. Based on operational characteristics indicated by the control signal, the method can include the step 208 in which the base unit 170 and in particular the microprocessor 186 may adjust the operation of the motor based on the control signal. The method proceeds by the step of 210 when the central station 168 may record and store all data obtained by the remote unit 166, all transmissions between the remote unit 166 and base unit 170, and any adjustments made based on the operating characteristics of the components of the pumpjack 50 for further review and analysis.

The foregoing disclosure has been illustrated and described in accordance with the relevant legal standards, it is not intended that these examples illustrate and describe all possible forms of the present disclosure, thus the description is exemplary rather than limiting in nature. Variations and modifications to the disclosed examples may become apparent to those skilled in the art and fall within the scope of the present disclosure. Additionally, the features and various implementing examples may be combined to form further examples of the present disclosure.

What is claimed is:

1. An integrated wireless data system for measurement of operating characteristics of a pumpjack, comprising:

a remote unit mounted to the pumpjack having at least one sensor and a remote transceiver and an amplifier and an A/D converter and at least one low impedance switch and a microprocessor, said remote unit configured to measure data associated with the operational characteristics of the pumpjack;

said remote unit including a power storage device connected to and providing power to said remote unit;

a base unit located in a motor control panel of the pumpjack having a base transceiver and an amplifier and a microprocessor connected to and in communication with a motor controller for controlling a motor of the pumpjack;

and said remote unit and said base unit wirelessly communicate with one another to exchange the data in real-time bi-directionally, wherein said base unit is configured to send a signal to said remote unit to alter at least one of a plurality of data collection parameters of the data associated with the operational characteristics of the pumpjack.

2. The system of claim 1, wherein the remote unit is mounted on a polished rod of the pumpjack.

3. The system of claim 2, wherein said at least one sensor includes a strain gauge connected to said microprocessor of said remote unit and wherein said microprocessor of said remote unit is adapted to measure various strain components of the polished rod.

4. The system of claim 3, wherein said at least one sensor includes a temperature sensor configured to provide raw temperature data.

5. The system of claim 1, wherein said amplifiers and said transceivers of said remote unit and said base unit are each configured to operate with a predetermined transmission power to reduce data drops between said base unit and said remote unit.

6. The system of claim 1, wherein said central station is configured to store data for later analysis.

7. The system of claim 1, wherein said remote unit is configured to measure the operational characteristics of the pumpjack at a rate of up to 4 kHz and said base unit is configured to resolve frequency signatures associated with pump and fluid interactions and rod and hole interactions and rod resonant frequency and control the motor of the pumpjack with a driving frequency determined through the use of feedback control.

8. The system of claim 1, further including a central station having a central station transceiver and an amplifier and connected to a personal computer, said central station configured to store and analyze the data measured by said remote unit and wherein said personal computer includes a database and said personal computer is configured to:

download the data measured by said remote unit from said central station; and store the data in a database for historical analysis.

9. The system of claim 1, wherein said remote unit is configured to continuously transmit the data associated with the operational characteristics of the pumpjack at a first frequency and transmit the data associated with the operational characteristics of the pumpjack at a second frequency higher than the first frequency in response to an anomaly in the data being identified.

10. The system of claim 1, wherein said data collection parameters include a revised calibration for one of said at least one sensor and said remote unit is configured to alter said revised calibration in response to receiving the signal to alter at least one of said plurality of data collection parameters of the data associated with the operational characteristics of the pumpjack.

11. The system of claim 1, wherein said data collection parameters include a transmission energy and said remote unit is configured to alter said transmission energy in response to receiving the signal to alter at least one of said plurality of data collection parameters of the data associated with the operational characteristics of the pumpjack.

12. The system of claim 1, wherein said at least one sensor includes a strain gauge and an accelerometer connected to said microprocessor of said remote unit and wherein said microprocessor of said remote unit is configured to measure both various strain components and acceleration of the polished rod using said strain gauge and said accelerometer.

* * * * *